US005517771A

United States Patent [19]

Paris et al.

[11] Patent Number: 5,517,771

[45] Date of Patent: May 21, 1996

[54] SKI BOOT EQUIPPED WITH A SUSPENDED FRONT COVER

[75] Inventors: Jean Paris, Sevrier; Bruno Pilon, Annecy; Louis Benoit, La Balme de Sillingy, all of France

[73] Assignee: Salomon S.A., Chavanod, France

[21] Appl. No.: 364,206

[22] Filed: Dec. 27, 1994

[30] Foreign Application Priority Data

Dec. 24, 1994 [FR] France ..... 93 15945

[51] Int. Cl.[6] ..... A43B 5/04

[52] U.S. Cl. ..... 36/120; 36/117

[58] Field of Search ..... 36/117, 118, 119, 36/120, 121

[56] References Cited

U.S. PATENT DOCUMENTS

| | | | |
|---|---|---|---|
| 4,841,650 | 6/1989 | Dodge et al. | 36/120 X |
| 5,216,826 | 6/1993 | Chaigne et al. | 36/120 X |
| 5,329,707 | 7/1994 | Chaigne et al. | 36/120 |
| 5,381,612 | 1/1995 | Paris | 36/120 X |

FOREIGN PATENT DOCUMENTS

| | | |
|---|---|---|
| 232218 | 8/1987 | European Pat. Off. . |
| 479123 | 4/1992 | European Pat. Off. . |
| 2511229 | 2/1983 | France . |
| 1963342 | 6/1971 | Germany . |

*Primary Examiner*—Paul T. Sewell
*Assistant Examiner*—Ted Kavanaugh
*Attorney, Agent, or Firm*—Pollock, Vande Sande & Priddy

[57] ABSTRACT

A rear-entry alpine ski boot whose shell base (1), surmounted by an upper (2) incorporating a rear cover (3) and a cuff (4), comprises a front cover (5) for closing an upper opening (6) provided in the boot. The front cover (5) is flexible and is suspended between a front point of support (14) and a rear point of support (16), and an area of overlap (8) of the front cover (5) with the cuff (4) is located above the area corresponding to the flexible bend of the skier's foot and in association with the position (H) of the axis of articulation of the cuff (4) on the shell base (1).

10 Claims, 4 Drawing Sheets

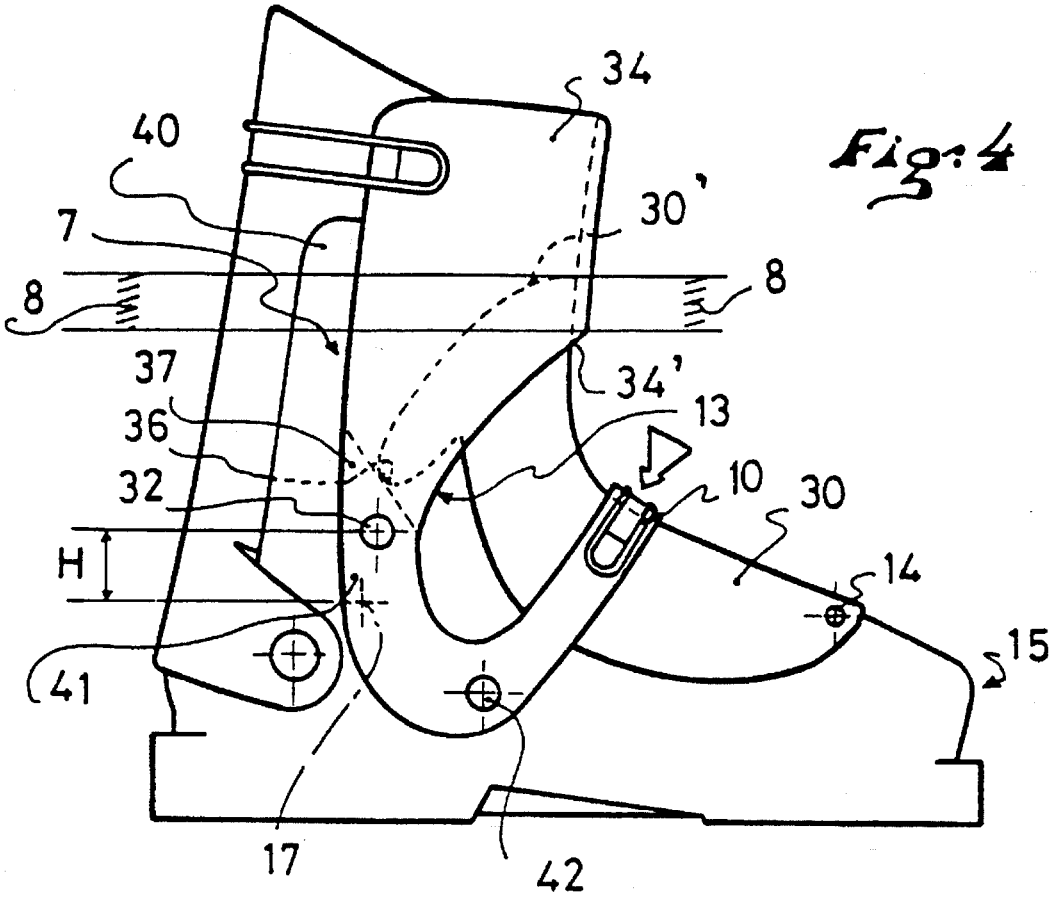
Fig: 4
Fig: 1b
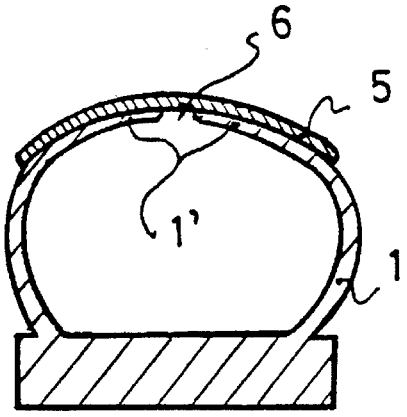
Fig: 1a
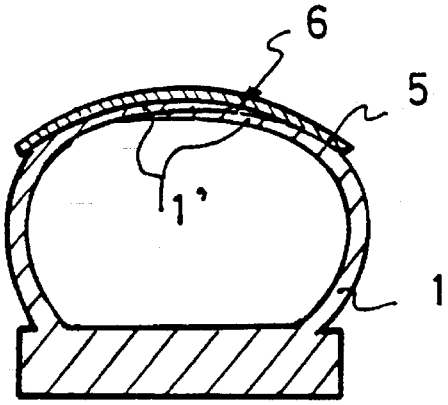

SKI BOOT EQUIPPED WITH A SUSPENDED FRONT COVER

FIELD OF THE INVENTION

The present invention relates to a rear-entry alpine ski boot incorporating a rigid or semi-rigid shell, in which the shell base, surmounted by an upper incorporating a rear cover and a component forming a cuff, comprises a cover which closes the front area matching up with the flexible bend of the front part of the skier's foot, and to the front structure of the upper.

BACKGROUND OF THE INVENTION

In this type of boot, the rigid shell provides the most effective solution guaranteeing that the skier's lower leg will be held firmly in place and ensuring water-tightness, thermal insulation, and, above all, the almost entirely rigid, mechanical transmission of the points of support between the lower leg and the ski. On the other hand, this solution requires the use of internal tightening means which provide for adjustment to the morphology of the foot and its position-retention, these means being totally separate from the means for tightening and/or closing the upper over the lower leg. Moreover, because the foot has multiple joints, design of the internal tightening means also requires consideration of the volume enclosed in the boot when movement dynamics take place, while taking into account the variations of the foot between its static and load-bearing positions. These variations may measure approximately 12 millimeters in width, 5 millimeters in length, and 2 millimeters resulting from the increased volume of the malleoli. In fact, to ensure ideal support of the foot, the internal tightening means must provide the various support configurations required (seating; transverse position-retention, etc.), while allowing the indispensable degree of freedom necessary to be able to adopt without obstacle the extreme positions which the load-bearing foot may take during skiing. These degrees of freedom are also necessary so as not to impede blood circulation and/or nerve perceptions.

To solve these problems relating to differentiated tightening systems between the lower leg and the foot and to the position-retention of the foot while fulfilling the requirements governing the range of freedom in conventional boots of the type specified above, several structures of the upper have been proposed. As an example, mention may be made of the boots described in EP 479 123 and DE 19 63 342, and in EP 232 218 and FR 2 498 431.

In the example given by patent application No. DE 19 63 342, the ski boot has a shell open longitudinally and in which the front part of the upper is formed from several successive elements jointed together beginning at a boot end-piece which is, in turn, jointed to the shell base. According to this disclosure, foot-tightening and position-maintenance are obtained by means of a tightening device which presses the boot end-piece on a lining made of a honeycomb material inserted between this end-piece and the top of the foot, at the same time that this device acts on the water-tight tongues which delimit the longitudinal opening. As regards position-maintenance and tightening of the upper over the lower leg, a strap encloses the upper element of the front portion of the upper, which in fact forms a cuff, and the rear cover is positioned on the wings emerging from the shell base. As is true for the foot, position-maintenance of the lower leg is produced by means of a honeycomb lining inserted between the lower leg and the upper components, i.e., the rear cover, the cuff, and the wings in the shell base.

By virtue of this structure of the front part of the boot upper, the tightening systems are clearly distinguished, but the foot is continuously compressed. Indeed, because the vertical motion of the jointed elements belonging to this front structure in relation to the top of the foot is not limited, it is the foot which forms the lower closing stop restricting the motion of these elements. Moreover, when the boot is closed and the foot becomes load-bearing, it is the foot which, when the size thereof varies during motion dynamics, must push these elements back so as to acquire the freedom of movement indispensable to it. Moreover, this upper structure does not guarantee a constant position of the front support configuration of the lower leg on the element forming a cuff from one boot to another and/or from one skier to another for a given size. In fact, since the lower closing stop of the front components composing the upper is the foot, a "strong" foot will position the cuff higher than does a "weak" foot. It will also be noted that the problem of impermeability between the cuff and the elements located on the foot is solved by a thin rubber lining, thereby complicating the manufacture of the front structure of the upper.

Again, because the cuff element is jointed in the area of articulation of the ankle to the intermediate element located substantially on the flexible bend area, the lower front edge of the cuff moves away from the upper edge of the intermediate element. Consequently, as soon as the element pivots on the front structure, it is no longer guided on the front and can become deformed transversely when the skier's lower leg becomes supported toward the front. This front structure of the upper thus does not guarantee virtually rigid, one-directional forward mechanical transmission.

In the example of the boot described in EP 232 218, the same disadvantage occurs, since the cuff is mounted in a stationary hinged configuration on the shell base in the area of articulation of the ankle, without being guided in the central part, which is simply connected to the shell base using a flexible covering element, whose function is to ensure the impermeability of the flexible bend/instep area, where an internal tightening mechanism is located. Accordingly, the stresses which could be transmitted transversely to the cuff cannot be counterbalanced otherwise than by joining the cuff to the shell base in the area of articulation of the ankle. It is clear that the greater the distance separating the area in which the skier's lower leg is supported on the cuff and the joint, the more the cuff risks becoming twisted or bent transversely.

As regards the position-maintenance of the lower leg, and thus the closing of the boot upper on the latter, another tightening mechanism connects the cuff belonging to the rear cover in the top part of the upper independently of the internal tightening system. In this boot, the front cover does not hold the foot in place internally, and use must be made of an internal tightening mechanism for that purpose.

For comparative purposes, the boot described in FR 2 498 431 has a front closing cover which itself ensures the position-maintenance of the foot using a tightening strap carried on the lower ends of the tabs fastening the cuff to the shell base. On the other hand, as in the boot in DE 19 63 342, downward travel of the front cover is not limited, and it thus rests continuously on the top of the foot, thereby generating a continuous pressure capable of altering blood flow or nerve perceptions. Moreover, because the front cover is located under the cuff which carries the tightening strap, any forward motion of this cuff simultaneously causes an increase in the tightening force applied by the strap on this cover, thereby generating a substantial increase of pressure on the foot.

In EP 479 123, the boot has a front closing cover fitted with internal foot-tightening means, and this cover is limited in its lower position on stops belonging to sliding lateral-connection devices, a rear vertical extension of the cover constituting the equivalent of a cuff. In this type of boot, the tightening systems, i.e., one for holding the foot and the other for holding the lower leg in place, are made separate, but, because the front cover, which forms one piece with the cuff, moves loosely within the limits dictated by the sliding lateral-connection devices, any forward flection of this cuff resulting from the support of the skier's lower leg causes variations in pressure on the skier's instep.

SUMMARY OF THE INVENTION

The present invention is intended to solve the problems relating to position-maintenance of the foot in rear-entry boots incorporating a cuff and front closing cover, while ensuring good impermeability between the cuff and the cover but without adding specifically-designed elements, and while avoiding pressure variations in the instep area during forward flection of the skier's lower leg by providing for support on the cuff. To this end, the invention proposes a system for the internal position-maintenance and/or tightening of the foot which does not squeeze the flesh, while permitting the indispensable range of free motion of the foot. In addition, the invention is intended to improve the mechanical transmission of the support forces holding the lower leg on the cuff, while continuously guiding the cuff on the front closing cover in synchrony with the pivoting motion of this cuff.

The ski boot according to the invention is a rear-entry boot whose shell base, surmounted by an upper incorporating a rear cover and a cuff, comprises a front cover intended to close an upper front opening in the foot area of the boot. The front cover has an elongated shape covering substantially the entire area extending along the front part of the foot up to the area of the flexible bend while extending upward toward the lower leg until its upper edge partially fits beneath the lower front edge of the cuff. By means of attachment tabs, the cuff is jointed to vertical wings emanating from the shell base up to a height "H" between the axis of articulation of the skier's ankle and, at a maximum, substantially corresponding to the height of the area of overlap of the upper edge of the front cover and the lower edge of the cuff. The front cover is suspended between a front point of support located in the area of the tip of the boot and a rear point of support located in proximity to the axis of articulation of the cuff.

According to one feature, the front cover has a degree of flexibility allowing elastic deformation of its middle portion between the front and rear points of support thereof, by means of a tightening system extending transversely over this front cover in at least the area of the flexible bend, and positioned so as to be stationary on the shell base on either side of the aforementioned front cover. Accordingly, it is possible to adjust with precision the position of the middle portion of the cover, which becomes more or less hollowed out in relation to the top of the foot without having to rest on the latter; and, accordingly, to impart to the foot the range of free motion required to accommodate these size variations between the static and load-bearing positions, without altering blood flow or nerve perceptions.

According to another feature, the cuff can bend forward according to a degree of angular amplitude around its axis of articulation on the wings of the shell base. This flective amplitude, which produces a lowered height "h" of the lower front edge of the cuff, since it rotates around the axis of articulation of this cuff, is preferably limited in relation to the curved area of the front cover positioned in order to match up with the flexible bend, so that the circular path of this edge can produce engagement only at the limit of flection.

BRIEF DESCRIPTION OF THE DRAWINGS

Other features and construction details will become evident in the following description provided with reference to the attached schematic drawings illustrating, as examples, several embodiments of the boot according to the invention.

FIGS. 1*a* and 1*b* are schematic cross-sections along line I*a*I*b*–I*a*I*b* of the boot in FIG. 1, showing two embodiments of the shell base in the area of the front cover.

FIG. 4 is a side view illustrating a ski boot fitted with a suspended front cover, still according to the invention, incorporating a mobile point of support which, in this embodiment, is located on the lateral tabs of the cuff.

DETAILED DESCRIPTION

Figure 1:
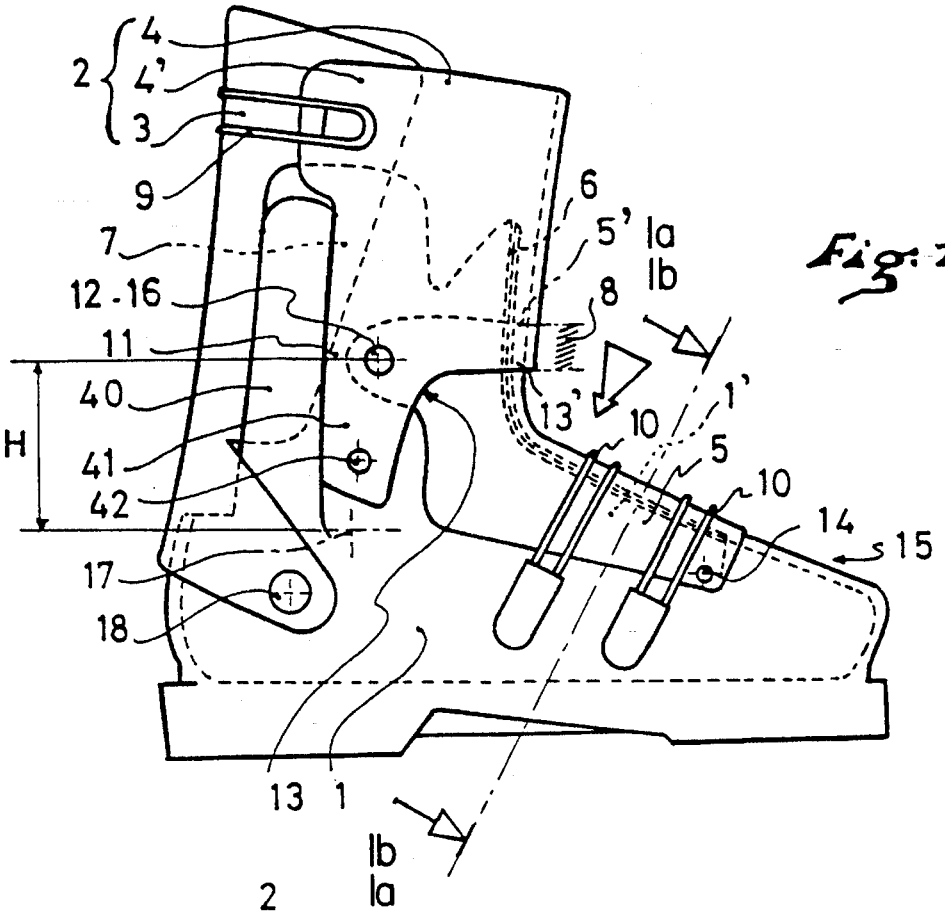
FIGS. 1 and 2 are side views of a ski boot equipped with a suspended front cover according to the invention, its points of support being made stationary on the shell base.
Figure 2:
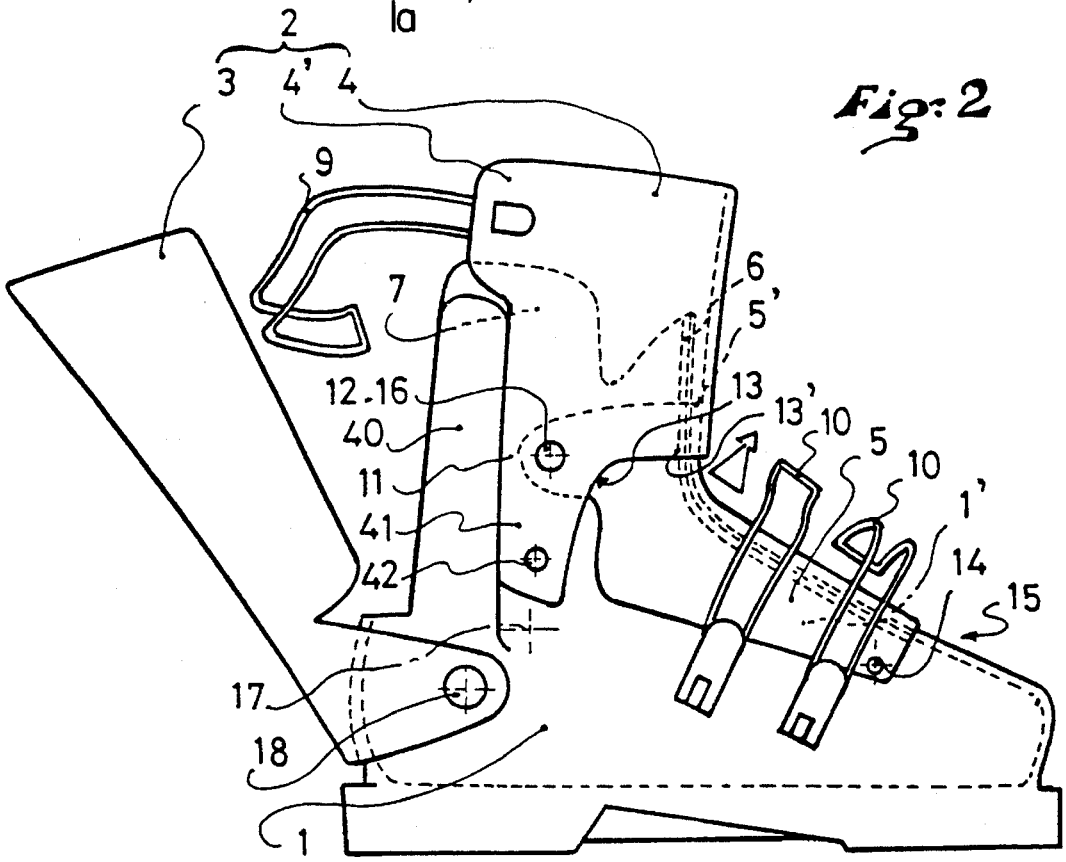

The ski boot shown in FIGS. 1 and 2 is of the rear-entry type and has an overall structure in which a shell base 1, surmounted by an upper 2 produced with a rear cover 3 and a cuff 4, comprises a front cover 5 which closes an upper longitudinal opening 6 in the boot, and which extends from the heel at least to a point within the area of the foot. As illustrated in FIGS. 1*a* and 1*b*, this opening 6 may equally well, at least in the area of the foot, be made with transverse tongues 1' which are extensions of the sides of the shell base 1 and whose free ends partially overlap or which simply remain separated. In fact, whatever the embodiment selected for enclosing the top of the foot with these parts of the shell base, traditional comfort and covering elements, e.g., foam linings, socks, fabric, etc., are interposed between the foot and the aforementioned parts and/or transverse tongues.

Moreover, the shell base 1 incorporates vertical wings 7 which extend at least within the area corresponding to the area of the skier's ankle. Thus, the vertical wings delineate, transversely to the longitudinal axis of the shell base 1, a "U"-shaped profile closed off in the heel by the rear cover 3, which can retract by pivoting around its hinge 18 in order to allow the boot to be put on and taken off, and, in the front area of the foot, by the front cover 5, which remains stationary in position, and by the cuff 4 in the top part of the upper 2. The overall front structure of the upper 2 of this kind of boot thus comprises a cuff 4 and a front cover 5, which can partially overlap in an area 8 located above the flexible bend of the foot. Conventional tightening means 9, 10 close the boot and hold in place and anchor the lower leg and the foot in a differentiated manner. For example, the means 9 operate between the cuff 4 and the rear cover 3, and the means 10 act on the front cover 5. The cuff 4 has the shape of an inwardly-curved groove which, by means of its wings 4', partially overlaps the wings 7 of the shell base 1, and its lower portion is extended by two attachment tabs 11 connected in a pivoting configuration to these wings 7 by means of rivets 12, while a central, median indentation 13 leaves free the entire area of the skier's instep and flexible bend of the foot, this area being covered essentially by the front cover 5. This cover 5 has an elongated shape and covers substantially the entire area corresponding to the front part of the foot and extending to the area of the flexible bend, while extending upward to the front lower edge 13' of the indentation 13 in the cuff 4, beneath which the upper edge 5' of this cover is fitted. In accordance with the invention, this front cover 5 is mounted so as to be suspended between a front point of support 14, such as a rivet or interlocking pieces, located in the area of the tip 15 of the boot, and a rear point of support 16 located, in this example, at the hinge axis 12 of the cuff 4, from which it is indistinguishable. Because this cover possesses a certain flexibility and is thus suspended between its points of support 14 and 16, it can easily be deformed elastically in the direction of the top of the foot by means of a tightening system 10, a force which opposes bearing stress generated on this cover, which tends to force it to return to its initial, relaxed position. It is understood that the tightening system 10 the closest to the median area of the cover 5, and thus to the flexible bend, will prove the most effective. These tightening systems 10 must obviously extend transversely over the front cover 5 and be fastened by their two ends on either side of the shell base 1.

Figure 3:
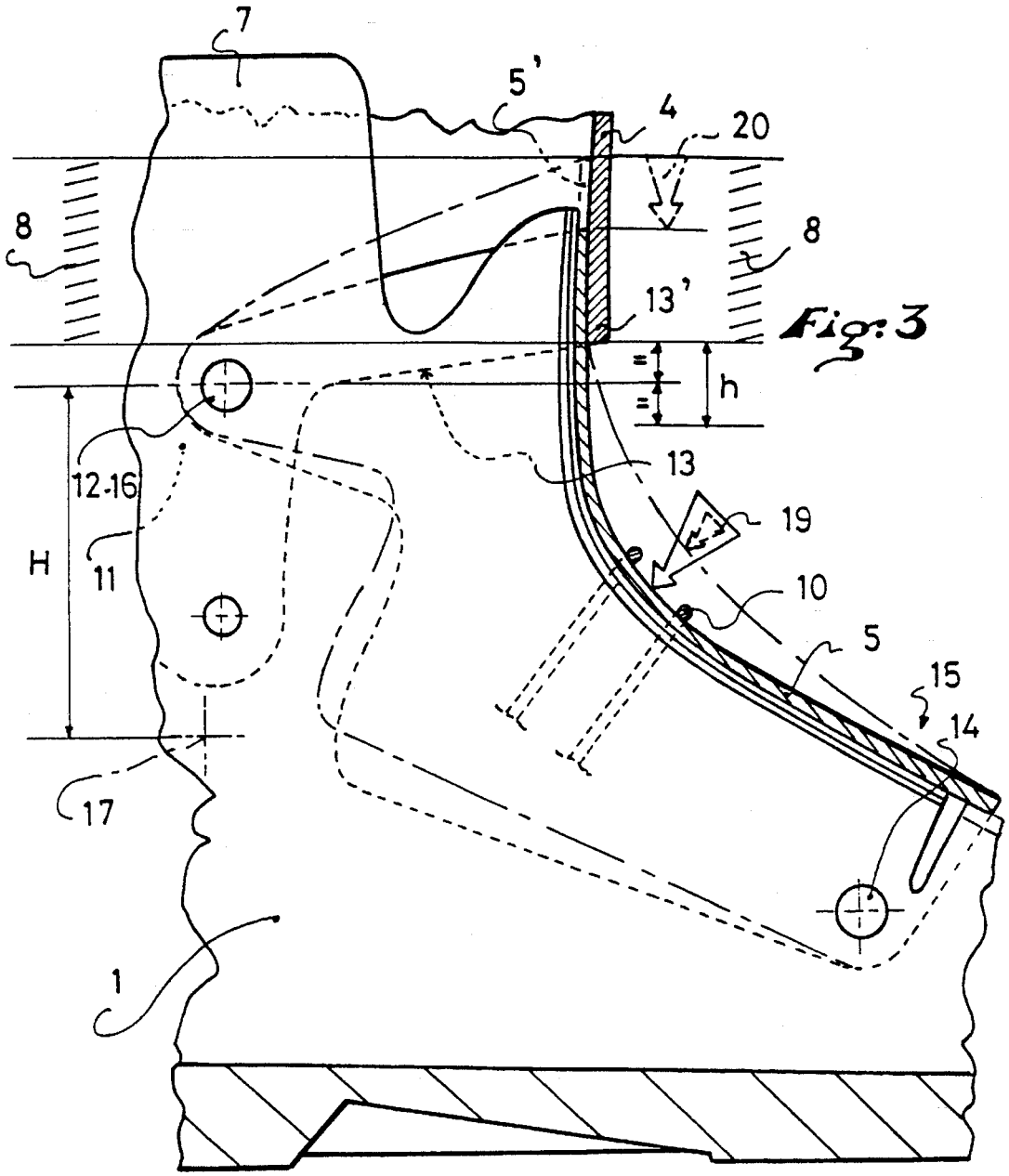
FIG. 3 is a partial longitudinal cross-section of the suspended front cover of the boot in FIGS. 1 and 2, shown between a resting and a tightened position.

According to a structural feature of this embodiment of the boot according to the invention, as shown most notably in FIG. 3, the cuff 4 is hinged at 12 by means of its attachment tabs 11 at a height "H" located above the area of articulation 17 of the skier's ankle, while corresponding substantially to the area of overlap 8 of the cuff 4 and the front cover 5, that is, the area in which the upper edge 5' of the latter fits beneath the lower edge 13' of this cuff. According to another structural feature, the area of overlap 8 is located at a height "h" above the flexible bend, that is, above the most highly-curved area of the front cover 5. This height "h" must correspond to a distance such that the circular path of the lower front edge 13' between its initial position and the extreme forward-pivoted position, the result of its rotation around the joint 12 when the cuff 4 pivots, causes engagement of this edge 13' on the curved area of the front cover only at the limit of flection. In fact, this height "h" as shown in FIG. 3 must correspond at least to the amplitude of flection of which the cuff 4 is capable. Thus, for example, if no engagement of the lower front edge 13' is desired at the extreme limit of flection of the cuff 4, the joint 12 of the cuff is advantageously positioned at a distance "H" from the axis of articulation 17 of the ankle and is located in the vertical dimension below the edge 13', thereby giving an approximate value of h/2. These structural features of the integral front unit of the boot according to the invention ensure, first, that the cuff 4 will exert no action on the front cover 5 in either the static or dynamic (forward flection) states, and, therefore, that the tightened position adjusted by means of the tightening system 10 on the front cover 5 will remain constant; and second, that the upper edge 5' of the cover and the lower front edge 13' of the cuff 4 will remain in close, permanent contact in the area 8 in which they overlap, since they pivot around the same joining/support axis 12–16. This close overlap in area 8 in fact ensures the central, continuous guidance of the cuff 4 when it pivots forward, since its lower front edge 13' is never released from its contact with the upper rear edge 5' of the cover 5; it also gives enhanced impermeability between the cover and cuff, which maintain their positional independence in relation to each other. In fact, when the cover 5 is tightened, e.g., in the direction of arrow 19, toward the foot, it can be seen that the upper edge 5' of the cover slides vertically without obstacle beneath the lower edge 13' of the cuff 4, as indicated by arrow 20. As can be clearly seen, the height of the area of overlap 8 is determined so as to always be greater than the height of the maximum vertical motion 20 of the upper edge 5' of the cover 5.

Figure 5:
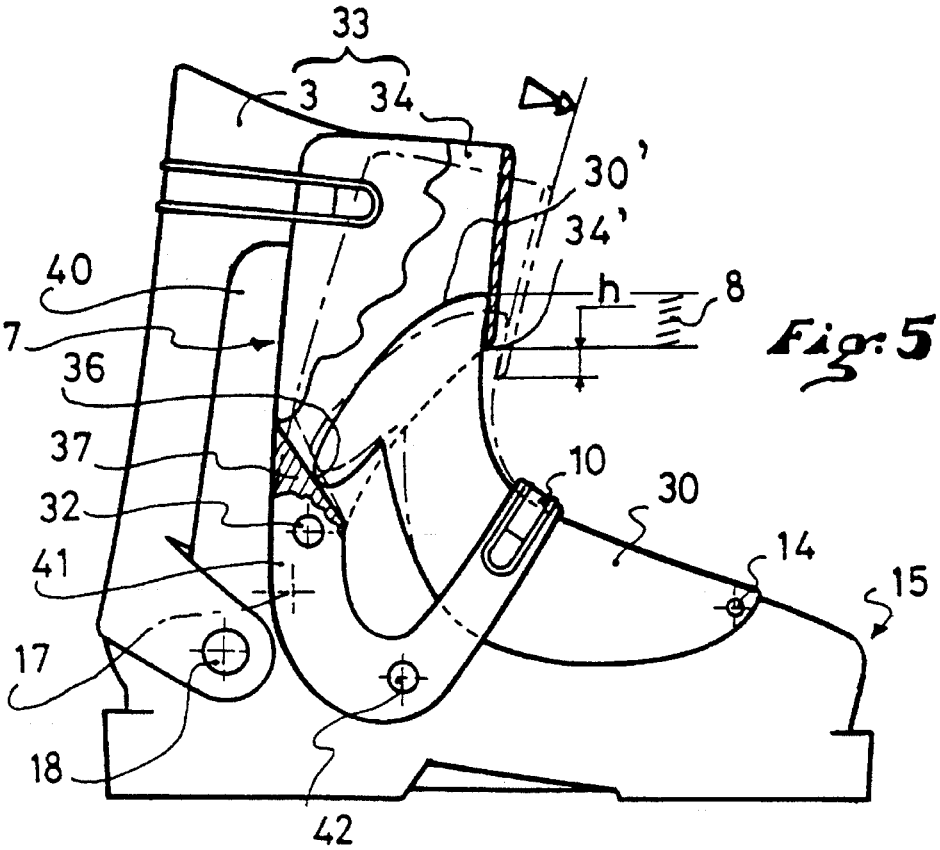
FIGS. 5 and 6 are partial, longitudinal cross-section views of the cuff of the boot in FIG. 4, showing the possible behavior of the suspended front cover between its foot position-maintenance and its flexed position, when the cuff pivots forward, and between its foot-position-maintenance and foot-release positions.
Figure 6:
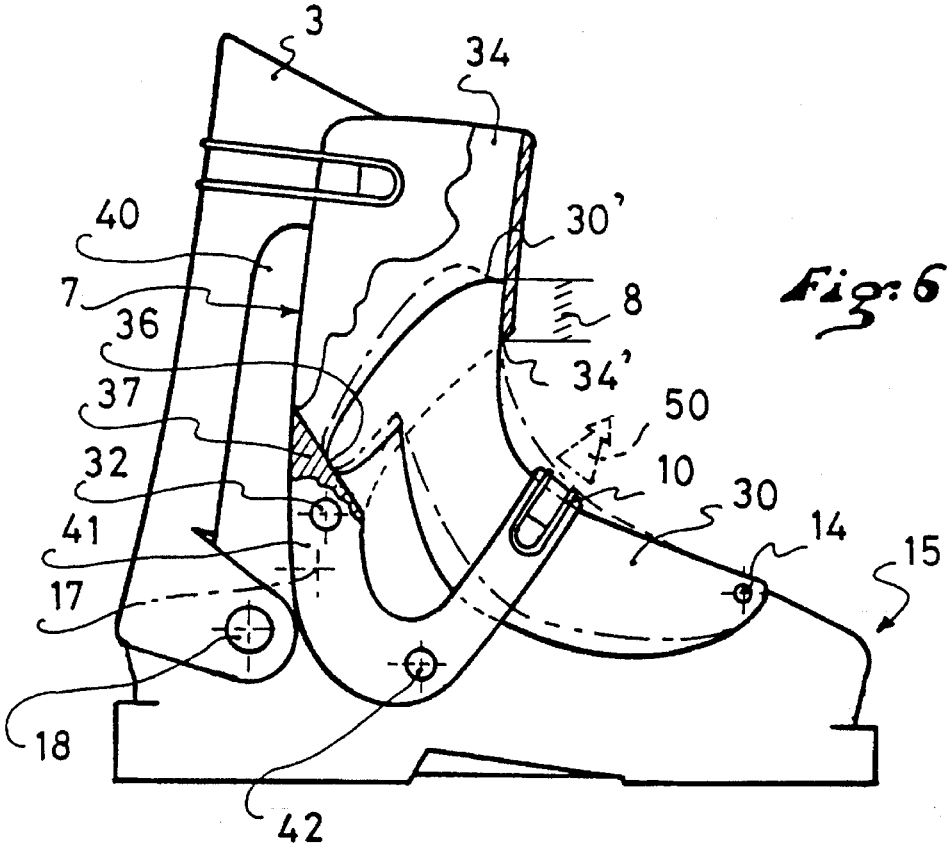

In the example shown in FIGS. 4, 5, and 6, the ski boot incorporates a basic structure similar to that shown in the preceding figures, and the description of the components of this basic structure will therefore not be repeated. However, in this embodiment the front cover 30 is suspended between a stationary front point of support 14 located toward the tip of the boot 15 and a rear point of support 36 capable of travel and located in proximity to the axis of articulation and connection 32 of the attachment tabs 37 of the cuff 34, the upper comprising the cuff and the rear cover 3. Here again, the axis of articulation 32 of the cuff 34 is positioned at a height "H" which is, this time, very close to the axis of articulation 17 of the skier's ankle and substantially below the area of overlap 8 of the upper edge 30' of the cover 30 and the lower edge 34' of the cuff 34. In this embodiment, the rear point of support 36 of the front cover 30 is formed by an inclined surface produced on each of the attachment tabs 37 of the cuff 34. This inclined surface 36 extends obliquely from its lowest to its highest point from the front to the rear of the boot, so that, when the cuff 34 pivots forward, the front cover 5 is forced to move simultaneously and in synchrony with the cuff in a substantially concomitant path, as shown by the dotted lines in FIG. 5. Despite the fact that this path causes the relative disengagement of the lower edge 34' of the cuff 34, this special configuration ensures simultaneous tracking with the upper edge 30' of the cover 30, and, therefore, effective central guidance of the cuff 34 through its motion.

Conversely, when the front cover 30 is released (FIG. 6), the point of support 36 constituted by the inclined surface allows this cover to be relaxed both in its median part, as indicated by arrow 50, and upward, by moving upward slightly on this inclined surface 36.

It is obvious that various modifications can be made to the basic structure of the rear-entry boot, while still remaining within the scope of the invention. For example, the vertical wings 7 of the shell base 1 may incorporate a raised support element 50, against which the rear portion of the cuff 4, 34 rests in the static position, and, in particular, when it is drawn rearward by the closing device 9 when the skier rests on the rear cover 3.

In addition, the cuff 4, 34 may incorporate extensions 41 of its attachment tabs 11 which do not extend beyond its axis of articulation 12. These extensions may advantageously possess a certain flexibility and be immobilized at a distance from the aforementioned axis of articulation 2 by an anchoring device 42. Accordingly, when the cuff 4, 34 is made to pivot forward, each extension 41 acts as a flection beam, thus constituting a device for the elastic control of the flection of this cuff.

Here again, as shown in FIGS. 4, 5, and 6, the extensions 41 of the attachment tabs belonging to the cuff 40 may extend beyond their anchoring devices 42, for example by extending upward on the instep or flexible bend, so as to constitute a part of the foot-tightening system 10.

What is claimed is:

1. A rear-entry ski boot having a shell base surmounted by an upper and including a rear cover and a cuff, said cuff comprising a front cover for closing a front upper opening provided in a foot area, said front cover having an elongated shape and covering substantially all of an area corresponding to a front part of a wearer's foot up to an area of a flexible bend of said foot, while extending upward toward a wearer's leg until fitting partially by an upper edge of said front cover beneath a lower front edge of said cuff, tightening means ensuring in differentiated fashion that said upper is closed over the lower leg and that the foot is held in position, wherein said cuff is jointed on an axis, by means of attachment tabs, to vertical wings protruding from said shell base to a height between an axis of articulation of an ankle of the wearer and, at a maximum, substantially in correspondence with an area of overlap of said upper edge and lower edge of said front cover and cuff, said front cover is suspended between a rear support point located in proximity to the axis of articulation of said cuff.

2. A ski boot according to claim 1, wherein said front cover exhibits a degree of flexibility making possible elastic deformation thereof between a front support point and said rear support point, and tightening means extending transversely on said cover in at least the area of said flexible bend are located on the shell base on either side of said front cover so as to produce the elastic deformation of said front cover which draws the latter closer to said flexible bend of said foot, in opposition to its elastic support reaction, which tends to draw it back into its initial, relaxed position.

3. Ski boot according to claim 2, wherein said front support point of said front cover is constituted by a stationary mechanical connection.

4. Ski boot according to claim 1, wherein said cuff is capable of pivoting forward over a certain angular amplitude so as to lower a height of the lower front edge thereof which, while rotating around the axis of articulation of said cuff, describes a path at its maximum bringing about substantially its engagement at a limit of flection in a direction of flexible bend of a foot of a skier.

5. Ski boot according to claim 1, wherein said rear support point of side front cover is constituted by an articulation of said cuff on said wings of said shell base.

6. Ski boot according to claim 1, wherein said rear support point of said front cover is constituted by an inclined surface provided on each of said attachment tabs of said cuff in proximity to axes of connection and articulation of said cuff.

7. Ski boot according to claim 1, wherein a portion of the front upper opening in said shell base closed by said front cover is delimited by transverse tongues which form extensions of sides of said shell base and which enclose the top of the wearer's foot.

8. Ski boot according to claim 7, wherein said tongues partially overlap by their free ends and delimit a longitudinal slot, which forms the front upper opening of said shell base.

9. Ski boot according to claim 1, wherein said attachment tabs of said cuff comprise a flexible extension which is attached and immobilized on a corresponding wing of said shell base at a distance from said axis of articulation, thus constituting a system for elastic control of flection of said cuff.

10. Ski boot according to claim 1, wherein said shell base incorporates, on its vertical wings, a raised support element against which the rear part of said cuff rests when drawn backward.

* * * * *